United States Patent [19]

Hansen et al.

[11] 3,998,631

[45] Dec. 21, 1976

[54] OXIDATION OF MOLTEN FERROPHOSPHOROUS

[75] Inventors: Donald J. Hansen, Lewiston; William B. De Atley, Grand Island; Robert L. Ripley, Niagara Falls; George F. Curtis, Lewiston, all of N.Y.

[73] Assignee: Union Carbide Corporation, New York, N.Y.

[22] Filed: Apr. 17, 1975

[21] Appl. No.: 568,983

[52] U.S. Cl. ..... 75/132; 75/1 R

[51] Int. Cl.[2] ..... C22C 33/04

[58] Field of Search ..... 423/62, 68, 61, 322, 423/323; 75/132, 1, 63

[56] References Cited

UNITED STATES PATENTS

| | | | |
|---|---|---|---|
| 3,305,355 | 2/1967 | Darrow | 75/1 |
| 3,677,741 | 7/1972 | Stenzel | 75/132 |
| 3,915,692 | 10/1975 | Herbert | 75/26 |

*Primary Examiner*—Peter D. Rosenberg
*Attorney, Agent, or Firm*—Frederick J. McCarthy, Jr.

[57] ABSTRACT

Oxidation of ferrophosphorous in an oxidizing environment wherein molten ferrophosphorous is continuously contacted with a surface of oxidized ferrophosphorous.

13 Claims, 2 Drawing Figures

OXIDATION OF MOLTEN FERROPHOSPHOROUS

The present invention relates to the oxidation of ferrophosphorous and to the concentration of vanadium present in ferrophosphorous.

Ferrophosphorous is a by-product of phosphorous and crude ferrophosphorous contains about 20 to 30% by weight phosphorous, 50 to 60% by weight iron, 2 to 9% by weight vanadium, up to about 8% weight chromium, silicon, titanium and nickel. The manufacture of phosphorous and the production of ferrophosphorous is described in U.S. Pat. Nos. 3,305,355; 3,154,410 and 3,699,213. While by-product, crude ferrophosphorous has some direct industrial uses, such as noted in the above-mentioned patents, oxidized ferrophosphorous containing about 40% by weight or more $P_2O_5$, e.g. 40 to 90% $P_2O_5$ is useful for pyrometallurgical purposes, and is especially useful, when containing relatively high proportions of vanadium, as a vanadium source in conventional roasting and leaching procedures used in the extraction of vanadium. Further, a ferrophosphorous material having a high phosphorous content, e.g. 23% or more, particularly when having a low content of vanadium, chromium and silicon, is highly desirable as a metallurgical additive. Previous efforts to achieve these end have been described in various United States patents. U.S. Pat. Nos. 3,154,410 and 3,305,355 — Darrow et al., describe a method for refining crude ferrophosphorous which involves the blowing of air or oxygen through molten ferrophosphorous contained in a vessel to provide an oxidized ferrophosphorous concentrate rich in vanadium and chromium, and a refined residual ferrophosphorous. This practice, which can be operated only as a batch process, due to the blowing of air or oxygen and the highly exothermic reaction of oxygen with ferrophosphorus proceeds with considerable heat and turbulence which requires careful equipment design. U.S. Pat. No. 3,460,937 — Rathman, describes a method for refining ferrophosphorous which involves the melting of ferrophosphorous with added slag into which the vandium from the ferrophosphorous is combined, and while this practice avoids difficulties encountered with oxygen blowing, it is necessary to handle and process substantially increased slag volumes.

It is an object of the present invention to provide a process for treating ferrophosphorous to provide oxidized ferrophosphorous. It is a further object of the present invention to provide a process for producing oxidized ferrophosphorous which can be practiced on a continuous basis.

It is another object of the present invention to provide a process for oxidizing ferrophosphorous to produce an oxidized ferrophosphorous product in which the vanadium content of the ferrophosphorous is concentrated, and a refined ferrophosphorous.

Figure 1:
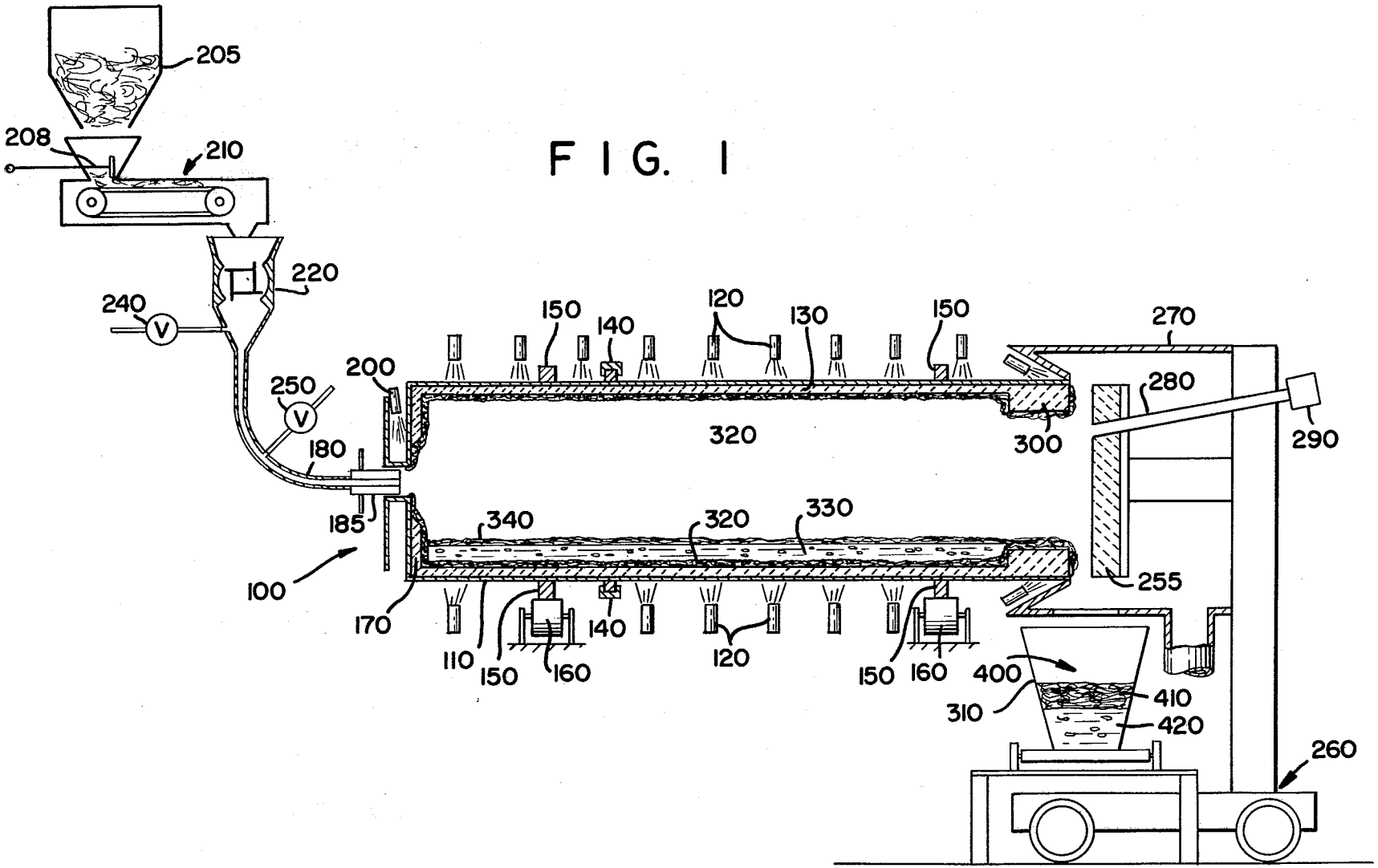
Figure 2:
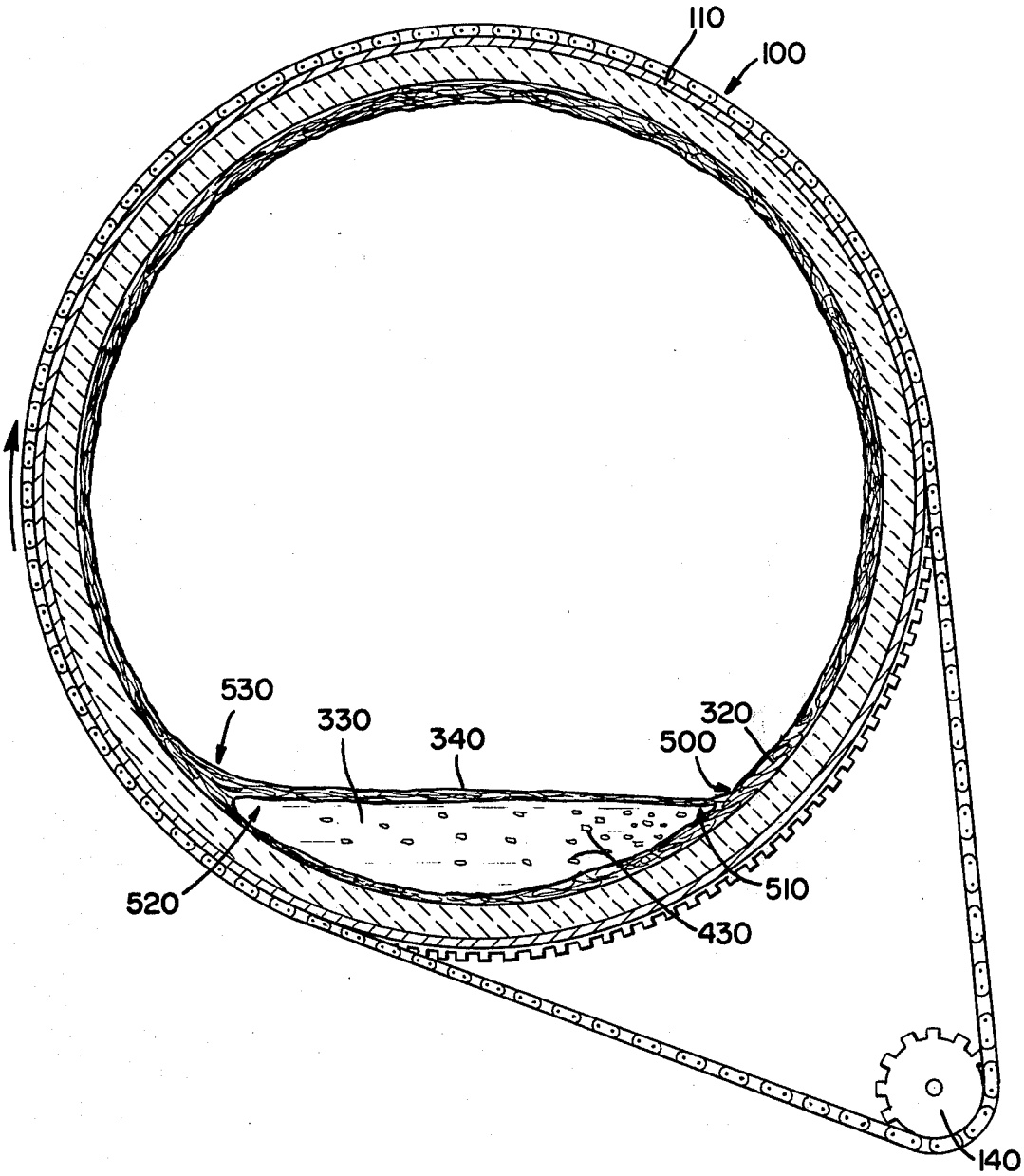

Other objects will be apparent from the following description and claims taken in conjunction with the drawing in which FIG. 1 shows a particular apparatus suitable for the present invention, and FIG. 2 shows a cross-section view of the kiln portion of the apparatus of FIG. 1.

A process in accordance with the present invention for producing oxidized ferrophosphorous comprises continuously bringing a molten mass of ferrophosphorous in and out of contact with a surface consisting essentially of oxidized ferrophosphorous in an oxidizing gas environment.

In the process of the present invention molten ferrophosphorous reacts with the oxidized ferrophosphorous surface when in contact therewith with the formation of oxidized ferrophosphorous in the molten mass; when the mass of molten ferrophosphorous and the surface are out of contact the oxidized ferrophosphorous surface is re-established and highly oxidized by the oxygen in the surrounding environment. In the course of the process, increasing amounts of oxidized ferrophosphorous are formed in the molten mass.

The present invention will be more fully understood with reference to the drawing in which FIG. 1 illustrates a rotating kiln type of apparatus for the practice of a particular embodiment of the present invention and FIG. 2 is a cross-section of the kiln apparatus of FIG. 1. In FIG. 1 a rotating kiln 100 comprises an outer metal shell 110 suitably made of plain carbon steel which can be cooled by conventional water-spray devices 120. An insulating refractory lining 130 is provided in contact with and interior shell 110. Kiln 100 is conventionally rotatable by means of a drive gear 140 conventionally engaging shell 110 and circumferential tire members 150 which are supported by rollers 160. Kiln 100 is provided with a conventional refractory seal 170 through which conduit 180 communicates with the interior of the kiln 100. Conduit 180, suitably of stainless steel pipe, is water-cooled as indicated at 185 and additional cooling is provided by water-spray devices 200. Feed hopper 205 is adapted to contain particulated solids which pass via a conventional gravimetric feeder 210 and rotary valve 220 through conduit 180 into kiln 100. The solid feed rate to kiln 100 is routinely controlled by adjustment of gate 208 of gravimetric feeder 210. Inlet 240 is arranged to introduce oxidizing gas into kiln 100 by way of conduit 180 and conduit 250 is arranged to introduce natural gas into kiln 100 by way of conduit 180. A moveable refractory heat reflecting member 255 is positioned adjacent the outlet end of kiln 100, supported on car 260. The outlet end of kiln 100 is enclosed by a hood 270. Passage 280, through hood 270 and reflecting member 250, is provided so that the temperature within kiln 100 can be measured by a radiation pyrometer indicated at 290 or by thermocouple devices which can be inserted through passage 280. Kiln 100 is provided with a circumferential refractory dam member 300 over which molten material from kiln 100 can overflow into a refractory vessel 310. In the practice of the present invention the interior of kiln 100 is suitably pre-heated by conventional techniques to above the melting point of ferrophosphorous, about 1250° C. This can be accomplished by passing natural gas and oxygen through conduits 180 and igniting the mixture. When the temperature inside kiln 100 reaches about 800° C., the natural gas introduction is discontinued and oxygen, or an oxygen-rich gas mixture is passed continuously through conduit 180 to establish an oxygen-containing atmosphere inside kiln 100. Particulated ferrophosphorous from feed hopper 205, suitably sized one-half inch and finer, is injected by the oxygen gas via conduit 180 into kiln 100. A portion of the ferrophosphorous material is ignited and reacts with oxygen in a highly exothermic manner upon entering kiln 100 and the kiln temperature increases due to the heat of reaction to above 1250° C. and ferrophosphorous material in the kiln becomes molten. The temperature in kiln 100 is suitably maintained in the range from about 1250° C. to 1475° C. by means of water-spray devices 120. With the kiln shell 110 being suitably rotated, the molten ferrophosphorous material continuously comes in contact with a conventional refractory lining 130 and by suitably cooling shell 110 using water-spray devices 120, e.g. to below about 100° C., molten ferrophosphorous will solidify in contact with the refractory lining and adhere thereto and form a substantially complete adherent coating 320 inside kiln 100 on refractory lining 130. For example, with an alumina refractory lining about 1 inch thick, arranged on a 0.1 inch thick steel shell cooled to below about 100° C., and a kiln temperature about 1250° C. a satisfactory adherent coating 320 of about ½ inch to 2 inches thick can be provided due to the temperature gradient established. Refractory lining 130 is not essential to the formation of an adherent coating 320 and by suitable cooling arrangements a satisfactory adherent oxidized ferrophosphorous lining can be provided on the metal kiln shell in place of the refractory lining.

When an adherent coating 320 is established, which initially is formed of ferrophosphorous and possibly particles of oxidized ferrophosphorous resulting from ignition of the same, the oxygen in the kiln reacts with the coating to provide an inner kiln surface of oxidized ferrophosphorous. Introduction of ferrophosphorous feed material and oxygen-rich gas, preferably 100% $O_2$, is continually introduced via conduit 180 into the oxygen rich environment of kiln 100 and forms in a molten mass 330 which overlies and contacts oxidized ferrophosphorous coating 320. Coating 320, due to the rotation of kiln shell 110, continuously moves in and out of contact with the molten mass of ferrophosphorous 330. A portion of the molten ferrophosphorous 330 is oxidized upon contact with adherent coating of oxidized ferrophosphorous 320, which thus becomes oxygen-depleted and the resultant oxidized ferrophosphorous, being less dense, accumulates as a surface lever 340. With the continuing introduction of ferrophosphorous feed material and oxygen, oxidized ferrophosphorous and refined unoxidized ferrophosphorous overflow dam 30 at the outlet of kiln 100 and are collected, for example in a refractory vessel 310. The kiln product material 400 can be allowed to stand in vessel 310 until the less dense oxidized ferrophosphorous accumulates in an upper layer 410 overlying refined unoxidized ferrophosphorous 420. The oxidized ferrophosphorous can then be readily separated, e.g. by decanting. The kiln product exiting the kiln can be handled by various techniques other than decanting, e.g. by solidifying the kiln product and thereafter separating the oxidized ferrophosphorous portion by fracturing the solid mass or by collecting the molten kiln product in a skimmer and separating the molten phases.

With reference to FIG. 2 which shows a cross-section of kiln 100, it can be observed that as a result of the rotation of kiln shell 110, molten ferrophosphorous 330 is continually placed in covering contact with the surface of the layer of oxidized ferrophosphorous 320 and upon such contact, oxygen from the oxidized ferrophosphorous layer material reacts and combines with ferrophosphorous in molten mass 330 with the formation of oxidized ferrophosphorous within mass 330, as indicated at 430, the thickness of the oxidized ferrophosphorous layer 320 being concurrently diminished. The thus formed oxidized ferrophosphorous 430, being less dense, rises through molten mass 320 and accumulates in layer 340. When upon further rotation of kiln shell 110, the diminished layer of oxidized ferrophosphorous is separated from covering contact with molten ferrophosphorous mass 330, the layer material thickness is re-established so that upon further rotation and re-contact with molten ferrophosphorous mass 330, the aforedescribed formation of oxidized ferrophosphorous is repeated. Consequently, it can be seen that the molten ferrophosphorous mass 330 is continuously contacted with a surface of oxidized ferrophosphorous and oxidized ferrophosphorous is continuously formed in molten mass 330 and the diminished layer 320 is continuously re-established. The following is believed to be representative of the operation of the present invention: With further reference to FIG. 2 location 500 illustrates a portion of the layer of oxidized ferrophosphorous 320 having a thickness corresponding to the initial thickness of the layer. The layer 320 is highly oxidized at location 500, due to being exposed to the oxygen gas environment within kiln shell 110 and has an oxygen content higher than the average oxygen content of layer 340, which is in contact with molten ferrophosphorous. As the oxidized ferrophosphorous layer passes under and into contact with the mass of molten ferrophosphorous 330 at location 510, oxidation of molten ferrophosphorous occurs in molten mass 330 due to reaction between molten ferrophosphorous and contacting oxidized ferrophosphorous from layer 320. That is to say a portion of the oxygen from the material of layer 320 partitions with the contacting matter ferrophosphorous and combines with molten ferrophosphorous to form oxidized ferrophosphorous as indicated at 430. This reaction continues as the oxidized ferrophosphorous layer moves toward location 520, the reaction tending to become less vigorous due to diminishing thickness and slightly lower temperature at the interface of molten ferrophosphorous with the layer 320. Upon separation from molten ferrophosphorous at location 530, oxidized ferrophosphorous adheres on the diminished layer in the vicinity of location 530 substantially resuming its initial thickness and being exposed to the oxidizing gas environment in kiln 100. Thus a re-newed layer of oxidized ferrophosphorous passes around again to location 500, becoming increasingly highly oxidized by exposure to oxygen and the formation of oxidized ferrophosphorous as described above is repeated. Additional formation of oxidized ferrophosphorous continuously occurs by diffusion of oxidizing gas from the atmosphere within kiln shell 100 into layers 340 and 330.

In accordance with the present invention as described above, oxidized ferrophosphorous can be produced continuously from crude ferrophosphorous at a surprisingly rapid rate and the vanadium, chromium and silicon contents of the crude ferrophosphorous are concentrated in the oxidized ferrophosphorous, the residual unoxidized ferrophosphorous being refined.

In practicing the present invention, the ratio of rate oxygen gas fed into a coated kiln 100 to the rate of ferrophosphorous feed material can be adjusted to provide the oxidization of a desired proportion of the ferrophosphorous feed material. For example, assuming no loss of oxygen from the kiln and a kiln temperature of 1250° C. or above, the following ratios apply:

| Weight of Oxygen Feed / Weight of Ferrophosphorous Feed* | % of Ferrophosphorous Feed Fully Oxidized** |
|---|---|
| 0.165 | 25 |
| 0.330 | 50 |
| 0.495 | 75 |
| 0.660 | 100 |

*Having a representative composition of 55% Fe, 24.46% P, 6.03% V, 2.11% Si, 4.42% Cr, 1.7% oxygen.
**100 (1- Wt of discharged refined ferrophosphorous/Wt of Ferrophosphorous Fed)

The foregoing ratios are based on the assumption that no oxygen is lost from the kiln. Under conditions where oxygen escapes from the kiln the ratios will be higher. For a particular kiln design a pilot run can be initially conducted to establish specific ratios for the kiln; initially relatively small amounts of oxygen and ferrophosphorous feed at relatively slow kiln rotation rates can be used. With the ratios established for the particular kiln design the throughput of the kiln can be increased, using increasing kiln rotations to establish an optimum kiln throughput.

For a kiln of 24 inches inner diameter, 7.2 feet long, with a kiln rotation rate of about 4 rpm, a ferrophosphorous feed rate of about 900 pounds per hour and an oxygen feed rate of about 300 pounds per hour would be effective, with the kiln constructed to avoid escape of oxygen, in fully oxidizing about 50% of the ferrophosphorous feed material.

In practice of the present invention, oxidized ferrophosphorous material can be produced containing up to 98% by weight of the vanadium of the crude ferrophosphorous feed material.

The following example will further illustrate the present invention.

EXAMPLE I

A rotating kiln apparatus was used having a kiln length of 7.2 ft., an inner kiln diameter of 24 inches, a 1 inch lining of alumina and an enclosing 0.1 inch thick steel shell. The apparatus was of the type shown in FIG. 1 except that end closures were not placed at the outlet end of the kiln and the ferrophosphorous feed was fed by gravity through a separate conduit adjacent the oxygen inlet conduit. The kiln was flushed with air and natural gas was introduced into the kiln and ignited by a torch located at the outlet end of the kiln and withdrawn after the natural gas was ignited. Ferrophosphorous feed material sized 8 mesh and finer was fed into the kiln and oxygen was introduced into the kiln and ferrophosphorous feed material commenced burning, i.e. reacting exothermically with the oxygen. A portion of the ferrophosphorous material became molten and solifidied in contact with the alumina lining of the kiln and adhered thereto. The kiln was rotated at 4 rpm and an adherent coating of oxidized ferrophosphorous, about 1 inch thick was formed covering the alumina lining of the kiln. The outer steel shell of the kiln was cooled to below about 100° C. by water spraying. Ferrophosphorous feed material was continuously introduced and as the temperature in the kiln increased to about 1250° C. due to the exothermic reaction between ferrophosphorous and oxygen, molten ferrophosphorous formed in a pool in the kiln extending to the 2 inch dam at the discharge end of the kiln. Ferrophosphorous feed material, oxygen and natural gas were continuously fed to the kiln which was rotated at 4 rpm, and the material overflowing the dam at the outlet end of the kiln was collected. During operation the kiln temperature ranged from 1250° to about 1425° C., reaching a temperature of about 1310° C. about 1 hour and 15 minutes after commencing ferrophosphorous feed and reaching about 1425° C. about 1 hour and 10 minutes later. The above temperatures were measured by thermocouples in the center of the kiln at 3 feet from the outlet end of the kiln. The following data was obtained for a 5 hour and 15 minute test period, subsequent to the time the kiln temperature reached 1250° C.:

| | |
|---|---|
| Ferrophosphorous Feed Material | 3776 lbs. |
| Oxygen | 2681 lbs. |
| Natural Gas | 54 lbs. |
| Kiln Product | 3820 lbs. |
| Residual Material in Kiln (Calculated) | 1000 lbs. |

Ferrophosphorous Feed Material Analysis 24.27% P
54.50% Fe
10.70% $V_2O_5$
4.42% Cr
2.11% Si
2.0% O
Balance Ni, Ti Analysis of Oxidized Ferrophosphorous in Kiln Product 14% P
29.7% Fe
9.23% $V_2O_5$
40.7% $O_2$
Balance essentially. Ni, Ti Analysis of refined Ferrophosphorous in Kiln Product 26.3% P
67.5% Fe
0.69% $V_2O_5$
0.010% Si
0.33% $O_2$
Balance essentially Ni, Ti

| | |
|---|---|
| Calculated Amount of Ferrophosphorous in Kiln Product | 905 lbs. |
| Calculated Amount of Oxidized Ferrophosphorous in Kiln Product | 2915 lbs. |
| $V_2O_5$ in Oxidized Ferrophosphorous (98% of $V_2O_5$ in kiln product) | 269 lbs. |
| $V_2O_5$ in Refined Ferrophosphorous (2.2% of $V_2O_5$ in kiln product) | 6.24 lbs. |

The results of the foregoing example show that about 98% of the $V_2O_5$ in the feed material was extracted from the ferrophosphorous feed material and concentrated in the oxidized ferrophosphorous product by fully oxidizing only about two-thirds of the ferrophosphorous feed material while the unoxidized ferrophosphorous was refined to a very low silicon content and had a phosphorous content increased by about 8%.

While the foregoing description has particularly described the use of a rotating kiln in the practice of the present invention, it is to be understood that other apparatus can be used. For example, a mass of molten ferrophosphorous can be continuously transferred to and from a vessel having a lining of oxidized ferrophosphorous utilizing an appropriate oxidizing environment. Also, stirring devices having a lining of oxidized ferrophosphorous can be used.

In the practice of the present invention, the gaseous atmosphere within the kiln is preferably at least 60% by volume oxygen. Oxygen-rich atmospheres containing lesser proportions of oxygen may possibly be employed provided that the operating temperature within the kiln is not excessively lowered.

The mesh sizes referred to herein are U.S. series.

What is claimed is:

1. A process for producing oxidized ferrophosphorous which comprises providing a coating consisting essentially of oxidized ferrophosphorous on a substrate; bringing a molten mass of ferrophosphorous into and out of contact with said coating in an atmosphere of oxidizing gas by providing relaive movement between substantially all of said molten mass of ferrophosphorous and said coating on said substrate to provide repeated covering and uncovering of at least a portion of said coating by molten ferrophosphorous and the formation of oxidized ferrophosphorous.

2. A method for producing oxidized ferrophosphorous which comprises an adherent coating consisting essentially of oxidized ferrophosphorous on at least a circumferential portion of the interior surface of a substantially horizontal rotating kiln; providing within said rotating kiln a mass of molten ferrophosphorous and an oxidizing gas atmosphere, said mass of molten ferrophosphorous being adjacent a portion of said coating, and withdrawing oxidized ferrophosphorous from said rotating kiln.

3. A method in accordance with claim 2 wherein said adherent coating consisting essentially of oxidized ferrophosphorous is provided by establishing a temperature at the interior surface of said rotating kiln sufficient to solidify a portion of molten ferrophosphorous in contact therewith.

4. A method in accordance with claim 2 wherein ferrophosphorous and oxidizing gas are continuously introduced into said rotating kiln, the temperature in the rotating kiln being such that the introduced ferrophosphorous becomes part of said mass of molten ferrophosphorous.

5. A method in accordance with claim 1 wherein said oxidizing gas is oxygen.

6. A method in accordance with claim 2 wherein said oxidizing gas is oxygen.

7. A method in accordance with claim 1 wherein said molten ferrophosphorous initially has a vanadium content of about 2 to 9% by weight, said vanadium content of the molten ferrophosphorous decreasing with the formation of oxidized ferrophosphorous and being concentrated in the formed oxidized ferrophosphorous.

8. A method in accordance with claim 2 wherein said molten ferrophosphorous initially has a vanadium content of about 2 to 9% by weight, said vanadium content of the molten ferrophosphorous decreasing with the formation of oxidized ferrophosphorous and being concentrated in the formed oxidized ferrophosphorous.

9. A process for producing oxidized ferrophosphorous in a rotating type horizontal kiln which comprises i. introducing ferrophosphorous into a kiln, said kiln being at a temperature such that said ferrophosphorous forms a layer of molten ferrophosphorous in said kiln and the temperature of the interior surface of said kiln being such that a portion of said molten ferrophosphorous in contact with said surface adheres thereto and forms a circumferential coating of ferrophosphorous on the interior surface of said kiln upon the rotating of said kiln;

ii. providing an atmosphere of oxidizing gas within said kiln to oxidize said coating and provide a circumferential coating consisting essentially of oxidizing ferrophosphorous;

iii. continuously introducing ferrophosphorous and oxidizing gas into said kiln, the temperature of the kiln being such that the introduced ferrophosphorous forms a layer of molten ferrophosphorous in said kiln;

iv. rotating said kiln to cause said layer of molten ferrophosphorous to continuously pass into covering contact with a portion of said circumferential oxidized ferrophosphorous coating to form oxidized ferrophosphorous within said layer of molten ferrophosphorous and diminish the thickness of said coating of oxidized ferrophosphorous.

10. A method in accordance with claim 9 wherein a layer of oxidized ferrophosphorous is provided in covering contact above said layer of molten ferrophosphorous and continuously passes into contact with said diminished coating of oxidized ferrophosphorous to substantially re-establish said coating of oxidized ferrophosphorous.

11. A method in accordance with claim 9 wherein oxidized ferrophosphorous formed in said layer of molten ferrophosphorous collects in a layer above said layer of molten ferrophosphorous.

12. A method in accordance with claim 9 wherein said oxidizing gas is oxygen.

13. A method in accordance with claim 9 wherein said molten ferrophosphorous initially has a vanadium content of about 2 to 9% by weight, said vanadium content of the molten ferrophosphorous decreasing with the formation of oxidized ferrophosphorous and being concentrated in the formed oxidized ferrophosphorous.

* * * * *

UNITED STATES PATENT OFFICE

CERTIFICATE OF CORRECTION

Patent No. 3,998,631 Dated December 21, 1976

Inventor(s) Donald J. Hansen, et al.

It is certified that error appears in the above-identified patent and that said Letters Patent are hereby corrected as shown below:

Column 7, line 24 after "comprises" add --providing--

Column 8, lines 20 and 21 "oxidizing" should read --oxidized--.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*